US007956021B2

(12) United States Patent
Nagamatsu

(10) Patent No.: US 7,956,021 B2
(45) **Date of Patent: *Jun. 7, 2011**

(54) DIESEL ENGINE LUBRICATING OIL COMPOSITION FOR LARGE-BORE TWO-STROKE CROSS-HEAD DIESEL ENGINES

(75) Inventor: Hiroyuki Nagamatsu, Gotenba (JP)

(73) Assignee: Chevron Japan Ltd., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/613,101

(22) Filed: Dec. 19, 2006

(65) Prior Publication Data

US 2007/0149420 A1 Jun. 28, 2007

(30) Foreign Application Priority Data

Dec. 28, 2005 (JP) ..... 2005-376930

(51) Int. Cl.
*C10M 159/24* (2006.01)
*C10M 141/10* (2006.01)
*C10M 159/22* (2006.01)

(52) U.S. Cl. ..... 508/391; 508/192; 508/291; 508/375; 508/574

(58) Field of Classification Search ..... 508/192, 508/291, 391, 375, 378, 574
See application file for complete search history.

(56) References Cited

U.S. PATENT DOCUMENTS

| | | | | |
|---|---|---|---|---|
| 4,948,522 | A | 8/1990 | Dunn et al. | |
| 6,310,011 | B1 * | 10/2001 | Karn et al. | 508/460 |
| 6,551,965 | B2 | 4/2003 | Nagamatsu et al. | |
| 2001/0019999 | A1 | 9/2001 | Nagamatsu et al. | |

FOREIGN PATENT DOCUMENTS

| | | |
|---|---|---|
| WO | WO 96/20265 | 7/1996 |
| WO | WO 97/46646 | 12/1997 |
| WO | WO 2005/112575 | 12/2005 |

OTHER PUBLICATIONS

International Search Report issued in counterpart European Patent Application No. 06256564.3-2104.
International Search Report issued in counterpart Singapore Patent Application No. 200608986-6.

* cited by examiner

*Primary Examiner* — Glenn A Caldarola
*Assistant Examiner* — Vishal Vasisth

(57) ABSTRACT

A lubricating oil composition comprising a base oil of lubricating viscosity having a kinematic viscosity of 22 to 300 $mm^2/s$ at 40° C. and dissolved or dispersed therein the following additives in the following amounts based on a total amount of the lubricating oil composition:

(1) an overbased sulfurized alkylphenol calcium salt detergent in an amount of 0.5 to 1.0 wt. % in terms of calcium content, (2) an overbased calcium alkylbenzenesulfonate detergent in an amount of 1.5 to 2.1 wt. % in terms of calcium content, (3) a nitrogen-containing ashless dispersant in an amount of 0.005 to 0.1 wt. % in terms of nitrogen content, and (4) a zinc dihydrocarbyldithiophosphate in an amount of 0.007 to 0.1 wt. % in terms of phosphorus content, wherein the weight ratio of the overbased sulfurized alkylphenol calcium salt detergent to the overbased calcium alkylbenzenesulfonate detergent is in the range of 22:78 to 37:63 in terms of calcium content and wherein the lubricating oil composition has a total base number of 60 to 100 mg·KOH/g. The lubricating oil composition of the present invention demonstrates high temperature wear and scuffing performance.

11 Claims, No Drawings

DIESEL ENGINE LUBRICATING OIL COMPOSITION FOR LARGE-BORE TWO-STROKE CROSS-HEAD DIESEL ENGINES

CROSS REFERENCE TO RELATED APPLICATIONS

This application claims priority from Japanese Patent Application Number 2005-376930, filed Dec. 28, 2005.

The present invention relates to a lubricating oil composition for diesel internal combustion engines. More specifically, the present invention relates to a lubricating oil composition favorably employable for lubricating two-stroke cross-head diesel engines installed in large ships or vessels. The lubricating oil composition of the present invention demonstrates high temperature wear and scuffing performance.

BACKGROUND OF THE INVENTION

For lubricating two-stroke cross-head diesel internal-combustion engines installed in large ships or vessels, lubricating oils generally called "marine cylinder lubricating oils" are used. In order to operate the internal-combustion engine smoothly, a predetermined amount of the lubricating oil is supplied into the cylinder at a predetermined position on the cylinder liner. Most lubricating oils used nowadays contain various additives to improve various performances and durability of the lubricating oils.

A typical lubricating oil for two-stroke cross-head diesel marine engines comprises a base oil showing a kinematic viscosity of approximately 22 to 300 $mm^2/s$ at 40° C. and additives dispersed or dissolved in the base oil such as an ashless dispersant and an overbased metal-containing detergent, e.g., an overbased calcium sulfonate, i.e., an overbased calcium alkylbenzenesulfonate detergent, an overbased calcium phenate, i.e., an overbased sulfurized alkylphenol calcium salt detergent, and an overbased calcium salicylate, i.e., an overbased alkylsalicylic acid calcium salt detergent. Most two-stroke cross-head diesel marine engines mainly burn petroleum fuel containing sulfur in a high content (generally, 2.5 to 4.0 wt. %) such as C fuel oil, and hence exhaust large amounts of acidic sulfur oxides (particularly, sulfuric acid) produced by combustion of the fuel. In order to neutralize the sulfur oxides, the lubricating oil compositions contains overbased metal-containing detergents and ashless dispersants. Further, the overbased metal-containing detergent and the ashless dispersant not only neutralize the sulfur oxides but also evenly disperse the residues of combustion, such as soot or sludge which is produced by deterioration of the fuel and the lubricating oil, so as to prevent residues from accumulating on the inner parts of the engine such as the piston, the piston groove, and the cylinder liner.

Recently, for the purpose of preventing environmental pollution, a requirement has been proposed to use low-sulfur fuels in two-stroke cross-head diesel marine engines. Accordingly, it is necessary to develop lubricating oils advantageously employable in combination with the low-sulfur fuel. In operating the diesel engine with low-sulfur fuel, the lubricating oil must have excellent thermal stability at high temperatures in order to maintain its abrasion-preventing performance, its wear-preventing performance and its scuffing-preventing performance.

In the case where overbased metal-containing detergents such as overbased calcium sulfonates, calcium salicylates and calcium phenates are used in combination in the lubricating oil composition, overbased calcium sulfonates and calcium salicylates are generally used in greater amounts than overbased calcium phenates. Overbased calcium phenates are more expensive components than overbased calcium sulfonates and calcium salicylates. Thus, it is more cost effective to use more of the later whenever possible.

U.S. Pat. No. 4,948,522 describes a cylinder lubricating oil composition for marine diesel engines. In the examples (set forth in Table 3 of col. 9) of this reference, it is shown that an overbased calcium sulfonate is used in an amount much more than an overbased calcium phenate (weight ratio is approximately 10:1 to 6:1).

U.S. Patent Publication 2001/0019999 and U.S. Pat. No. 6,551,965 also describe lubricating oil compositions favorably employable in the two-stroke cross-head diesel marine engines. In contrast with U.S. Pat. No. 4,948,522, the overbased calcium phenate is used in an amount more than the overbased calcium sulfonate (the weight ratio in terms of former:later is 55:45 to 95:5) in U.S. Patent Publication 2001/0019999 and U.S. Pat. No. 6,551,965. The lubricating oil composition further contains an ashless dispersant and a zinc dialkyldithiophosphate and/or a zinc diaryldithiophosphate. It is shown that the lubricating oil composition provides anti-wear performance.

While the conventional lubricating oil composition described in the prior art contain additive compositions comprising overbased metal-containing detergents with satisfactory lubrication performance such as thermal stability, such conventional lubricating oil compositions do not meet the present requirements imposed on two-stroke cross-head diesel marine engines operating on low sulfur fuel that have been recently developed or will be developed in the near future. The new larger bore two-stroke cross-head diesel marine engines run at high outputs and severe loads and the temperature of the cylinder liner are from 220 to 260° C. Thus, there is a need to develop new lubricating oil compositions that can meet the performance demands of such new generation two-stroke cross-head diesel marine engines.

SUMMARY OF THE INVENTION

The present invention relates to a lubricating oil composition for diesel internal combustion engines. More specifically, the present invention relates to a lubricating oil composition favorably employable for lubricating two-stroke cross-head diesel engines installed in large ships or vessels. The lubricating oil composition of the present invention demonstrates high temperature wear and scuffing performance.

Accordingly, in its broadest aspect, the present invention relates to a lubricating oil composition comprising a base oil of lubricating viscosity having a kinematic viscosity of 22 to 300 $mm_2/s$ at 40° C. and dissolved or dispersed therein the following additives in the following amounts based on a total amount of the lubricating oil composition:

(1) an overbased sulfurized alkylphenol calcium salt detergent in an amount of 0.5 to 1.0 wt. % in terms of calcium content, (2) an overbased calcium alkylbenzenesulfonate detergent in an amount of 1.5 to 2.1 wt. % in terms of calcium content, (3) a nitrogen-containing ashless dispersant in an amount of 0.005 to 0.1 wt. % in terms of nitrogen content, and (4) a zinc dihydrocarbyldithiophosphate in an amount of 0.007 to 0.1 wt. % in terms of phosphorus content.

wherein the weight ratio of the overbased sulfurized alkylphenol calcium salt detergent to the overbased calcium alkylbenzenesulfonate detergent is in the range of 22:78 to 37:63 in terms of calcium content and wherein the lubricating oil composition has a total base number of 60 to 100 mg·KOH/g.

In a further aspect, the present invention relates to a method of improving the high temperature wear performance of two-stroke engines wherein the method comprises operating the two-stroke engine with a lubricating oil composition of the present invention. Preferably, the two-stroke engine is a two-stroke cross-head diesel marine engine.

Among other aspects, the lubricating oil composition of the present invention shows excellent thermal stability and wear-preventing performance when it is used in high-power and high-load super long stroke engines burning low-sulfur fuel under conditions where the walls of the cylinder liner is heated to 200 to 260° C. Accordingly, when used in diesel marine engines, particularly, in two-stroke cross-head diesel marine engines (which are highly loaded and which is continuously operated for a long time) burning low-sulfur fuel, the lubricating oil composition of the present invention prevents production of black sludge, which originates from residue produced by combustion of the lubricating oil, preventing the accumulation of deposits on the upper surface of the piston or on the piston groove, and further prevents the piston top ring and the cylinder liner from wearing and scuffing. Further, from the viewpoint of cost, the lubricating oil composition of the present invention is more cost-effective than those disclosed in the prior art. This is because the lubricating oil composition of the present invention contains an overbased calcium alkylbenzenesulfonate detergent, which is available at a relatively low price, and thus can be used in a higher proportion than an overbased sulfurized alkylphenol calcium salt detergent, which is a relatively high priced component.

DETAILED DESCRIPTION OF THE INVENTION

It is an object of the present invention to provide a lubricating oil composition for two-stroke cross-head diesel marine engines installed in large ships or vessels. In particular, the present invention provides for a lubricating oil composition having thermal stability, high wear-preventing and scuffing performance at high temperatures and providing lubrication performances to meet the severe operation requirements imposed by two-stroke cross-head diesel marine engines that have been recently developed or shall be developed in the near future.

It has now been discovered that a diesel marine engine-cylinder lubricating oil composition containing a certain combination of an overbased calcium sulfonate detergent and an overbased calcium phenate detergent effectively prevents piston rings and cylinder liners from wearing and scuffing, if the ratio between the overbased compounds is adjusted in a specific range and an ashless dispersant and a zinc dihydrocarbyldithiophosphate, e.g., zinc dialkyldithiophosphate or zinc diaryldithiophosphate, are incorporated.

Accordingly, the present invention relates to a lubricating oil composition comprising a base oil of lubricating viscosity having a kinematic viscosity of 22 to 300 $mm^2/s$ at 40° C. and dissolved or dispersed therein the following additives in the following amounts based on a total amount of the lubricating oil composition:

(1) an overbased sulfurized alkylphenol calcium salt detergent in an amount of 0.5 to 1.0 wt. % in terms of calcium content, (2) an overbased calcium alkylbenzenesulfonate detergent in an amount of 1.5 to 2.1 wt. % in terms of calcium content, (3) a nitrogen-containing ashless dispersant in an amount of 0.005 to 0.1 wt. % in terms of nitrogen content, and (4) a zinc dihydrocarbyldithiophosphate in an amount of 0.007 to 0.1 wt. % in terms of phosphorus content, wherein the weight ratio of the overbased sulfurized alkylphenol calcium salt detergent to the overbased calcium alkylbenzenesulfonate detergent is in the range of 22:78 to 37:63 in terms of calcium content and wherein the lubricating oil composition has a total base number of 60 to 100 mg·KOH/g.

The preferred embodiments of the lubricating oil composition according to the present invention will be described in further detail below.

Overbased Sulfurized Alklyphenol Calcium Salt Detergent

The lubricating oil composition of the present invention contains an overbased sulfurized alkylphenol calcium salt detergent, i.e., overbased calcium sulfurized alkylphenate detergent, in an amount of 0.5 to 1.0 wt. % in terms of calcium content, based on the total amount of the lubricating oil composition.

The overbased calcium sulfurized alkylphenate detergent is a calcium salt of a sulfurized alkylphenol having an alkyl group of approximately 8 to 30 carbon atoms on average. As the overbased calcium sulfurized alkylphenate, it is advantageous to use an overbased calcium sulfurized alkylphenol (often simply referred to as "basic calcium sulfurized alkylphenol") having total base number (TBN) of 200 mg·KOH/g or more, preferably, 250 mg·KOH/g or more. The total base number (unit: mg·KOH/g) is measured according to ASTM D2896.

The above-mentioned overbased sulfurized alkylphenol calcium salt detergent having a total base number of 200 mg·KOH/g or more can be used in combination with an overbased sulfurized alkylphenol calcium salt having a total base number of less than 200 mg·KOH/g, preferably, TBN of 50 to 180 mg·KOH/g.

Overbased Calcium Alkylbenzenesulfonate Detergent

The lubricating oil composition of the present invention also contains an overbased calcium alkylbenzenesulfonate detergent, i.e., an overbased calcium alkylsulfonate, in an amount of 1.5 to 2.1 wt. % in terms of calcium content, based on the total amount of the lubricating oil composition.

The overbased calcium alkylsulfonate detergent is a calcium sulfonate of a mineral oil having a molecular weight of approximately 400 to 6,000 or of an aromatic compound having an alkyl group of approximately 8 to 30 carbon atoms on average. For example, it is possible to use an overbased calcium alkyloxybenzenesulfonate prepared according to the process disclosed in PCT Publication WO 96/20265. As the overbased calcium alkylsulfonate detergent, it is preferred to use an overbased calcium alkylsulfonate detergent having a total base number of 200 mg·KOH/g or more, preferably 250 mg·KOH/g or more, more preferably 350 mg·KOH/g or more, most preferably 450 mg·KOH/g or more. The overbased calcium alkylsulfonate detergent having a total base number of 200 mg·KOH/g or more can be used in combination with a low overbased calcium alkylsulfonate detergent having a total base number of less than 200 mg·KOH/g, preferably, TBN of 50 to 180 mg·KOH/g.

It should be noted that the weight ratio of the overbased sulfurized alkylphenol calcium salt detergent to the overbased calcium alkylbenzenesulfonate detergent in the lubricating oil composition of the present invention is in the range of 22:78 to 37:63 in terms of calcium content, preferably 23:77 to 36:64.

Nitrogen-Containing Ashless Dispersant

The lubricating oil composition of the present invention further contains a nitrogen-containing ashless dispersant in an amount of 0.005 to 0.1 wt. % in terms of nitrogen content, based on the total amount of the lubricating oil composition.

Examples of the nitrogen-containing ashless dispersant employed in the present invention include succinic imide, benzylamine, and their derivatives which may be modified with organic acids, inorganic acids, alcohols or esters. A particularly preferred nitrogen-containing ashless dispersant is succinic imide dispersant. The succinic imide dispersant can be obtained, for example, by the steps of reacting polybutene having an average molecular weight of 800 to 8,000 or chlorinated polybutene having an average molecular weight of 800 to 8,000 with maleic anhydride at a temperature of 100 to 200° C. to prepare polybutenylsuccinic anhydride, and then reacting the polybutenylsuccinic anhydride with polyamine. Examples of the polyamines include diethylenetriamine, triethylenetetramine, tetraethylenepentamine, pentaethylenehexamine, and hexaethyleneheptamine. The succinic imide dispersant preferably is a borated derivative thereof. The borated succinic imide dispersant can be prepared, for example, by reacting the above-mentioned reaction product between polybutenylsuccinic anhydride and polyamine with boric acid or a boric acid derivative.

Zinc Dihydrocarbyldithiophosphate

The lubricating oil composition of the present invention furthermore contains a zinc dihydrocarbyldithiophosphate, e.g., zinc dialkyldithiophosphate or zinc diaryldithiophosphate, in an amount of 0.007 to 0.1 wt. % in terms of phosphorus content, based on the total amount of the lubricating oil composition.

The alkyl group of the zinc dialkyldithiophosphate is a linear or branched, primary, secondary or tertiary alkyl group of 2 to 18 carbon atoms, such as ethyl, propyl, isopropyl, butyl, isobutyl, pentyl, hexyl, heptyl, octyl, decyl, dodecyl or octadecyl. The zinc diaryldithiophosphate, preferably is a zinc dialkylaryldithiophosphate, in which the alkylaryl group is, for example, a phenyl group having an alkyl group of $C_2$ to $C_{18}$ such as butylphenyl, nonylphenyl or dodecylphenyl.

Base Oil of Lubricating Viscosity

The base oil used in the lubricating oil composition of the present invention is a mineral or synthetic oil showing a kinematic viscosity of approximately 22 to 300 $mm^2/s$, preferably 22 to 200 $m^2/s$ at 40° C. The mineral oil can be an oil obtained by distilling crude oil under atmospheric or reduced pressure to obtain a distillate, and subjecting the distillate to a refining operation such as solvent extraction, hydrocracking, solvent dewaxing or hydrogenation refining.

It is preferred to use a major amount of base oil of lubricating viscosity in the lubricating oil of the present invention. A major amount of base oil of lubricating viscosity as defined herein comprises 40 wt % or more. Preferred amounts of base oil comprise 40 to 99.9 wt %, preferably greater than 50 to 97 wt %, more preferably 60 to 97 wt % of the lubricating oil composition. (When weight percent is used herein, it is based on the total weight percent of the lubricating oil composition unless otherwise specified.)

The lubricating oil composition of the present invention can be prepared by adding the additives independently or all at once to the base oil. Otherwise, an additive concentrate comprising the additives in high concentrations can be beforehand prepared and then mixed it with a base oil to prepare the lubricating oil composition of the present invention. The lubricating oil composition of the present invention can further contain other lubricant additives as described below.

Other Additive Components

The following additive components are examples of components that can be favorably employed in combination with the lubricating additive of the present invention. These examples of additives are provided to illustrate the present invention, but they are not intended to limit it.

(A) Oxidation Inhibitors:

1) Phenol type phenolic) oxidation inhibitors: 4,4'-methylenebis (2,6-di-tert-butylphenol),4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-a-dimethylamino-p-cresol, 2,6-di-tert-4(N, N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide and bis(3,5-di-tert-butyl-4-hydroxybenzyl).

2) Diphenylamine type oxidation inhibitor: alkylated diphenylamine, phenyl-a-naphthylamine and alkylated a-naphthylamine.

3) Other types: metal dithiocarbamate (e.g., zinc dithiocarbamate), and methylenebis(dibutyldithiocarbamate).

(B) Rust Inhibitors (Anti-Rust Agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol and phosphoric ester.

(C) Demulsifiers: addition product of alkylphenol and ethyleneoxide, polyoxyethylene alkyl ether and polyoxyethylene sorbitane ester.

(D) Extreme Pressure Agents (EP agents): sulfurized oils, diphenyl sulfide, methyl trichlorostearate, chlorinated naphthalene, benzyl iodide, fluoroalkylpolysiloxane and lead naphthenate.

(E) Friction Modifiers: fatty alcohol, fatty acid, amine, borated ester and other esters.

(F) Multifunctional Additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound and sulfur-containing molybdenum complex compounds.

(G) Viscosity Index Improvers (VII): polymethacrylate type polymers, ethylene-propylene copolymers, styrene-isoprene copolymers, hydrogenated styrene-isoprene copolymers, hydrogenated star-branched polyisoprene, polyisobutylene, hydrogenated star-branched styrene-isoprene copolymer and dispersant type viscosity index improvers.

(H) Pour Point Depressants: polymethyl methacrylates, alkylmethacrylates and dialkyl fumarate-vinyl acetate copolymers.

(I) Foam Inhibitors: alkyl methacrylate polymers and dimethyl silicone polymers.

EXAMPLES

The present invention will be further illustrated by the following examples, which set forth particularly advantageous method embodiments. While the Examples are provided to illustrate the present invention, they are not intended to limit it.

The additives and the base oil of lubricating viscosity employed in the below-described Examples and Comparative Examples are as follows:

(1) Phenate detergent: calcium phenate having TBN of 250 (Ca content: 9.6 wt. %)

(2) Sulfonate detergent: calcium sulfonate having TBN of 425 (Ca content: 16.1 wt. %)

(3) Ashless dispersant: bis-type succinimide (N content: 2.0 wt. %)

(4) Zinc dihydrocarbyldithiophosphate (Zn-DTP): zinc primary-alkyldithiophosphate (P content: 1.66 wt. %)

(5) Base oil of lubricating viscosity: mixture (kinematic viscosity: 180 $mm^2/s$ at 40° C.) comprising a base oil (kinematic viscosity: 11.0$mm^2/s$ at 100° C.) and a base oil (kinematic viscosity: 32.0 $mm^2/s$ at 100° C.) in the ratio of 60:40.

Examples 1 and 2

The above-mentioned additives were added to the base oil in amounts shown in Table 1 based on the atomic element content set forth in Table 1, to prepare lubricating oil compositions of the present invention (Examples 1 and 2). The lubricating oil compositions of the present invention had an SAE viscosity grade of 50 and a total base number (TBN, determined according to ASTM D2896) of 70 mg·KOH/g.

Comparative Examples A to G

The above-mentioned additives were added to the base oil in amounts shown in Table 1 based on the atomic element content set forth in Table 1, to prepare lubricating oil compositions for Comparative Examples A-G. The lubricating oil compositions for Comparative Examples A-G had an SAE viscosity grade of 50 and a total base number (TBN, determined according to D2896) of 70 mg·KOH/g. Comparative Examples C and D shows the calcium phenate was used in an amount larger than the amount of the calcium sulfonate.

Evaluation of Scuffing and Wear Observed on Cylinder

With respect to scuffing and wear on the cylinder, the lubricating oil compositions prepared in the Examples and the Comparative Examples were evaluated under conditions simulating their use as lubricating oils in two-stroke cross-head diesel marine engines. The evaluation test was carried out in the following manner. The results are set forth in Table 1.

Evaluation Test

Scuffing and wear were evaluated by means of a two-cylinder type rubbing friction-wear tester. Each sample oil composition and test pieces were placed in the tester, and the test was carried out to examine the wear and scuffing. The test pieces comprised a fixed piece and a rotating piece, and they were made of cast iron. The test was conducted according to the step-up loading method under the conditions of: sample composition: 60 mL, temperature: 280° C., rotation: 477 rpm, and slip speed: 1 m/sec. The load was increased step-by-step at a rate of 20 $kg/cm^2$ (2 MPa), and the test was continued for 130 minutes. After the test was complete, the worn amount of test pieces (in terms of μm) was measured. In the case where seizure happened, it was reported as scuffing, which is represented by "Scuff" in Table 1.

TABLE 1

| | Examples | | Comparative Examples | | | | | | |
|---|---|---|---|---|---|---|---|---|---|
| Component | 1 | 2 | A | B | C | D | E | F | G |
| Phenate Detergent (Phe) (Ca %) | 0.601 | 0.930 | 0.414 | 1.006 | 1.815 | 2.56 | — | 0.601 | 0.929 |
| Sulfonate Detergent (Sul) (Ca %) | 2.036 | 1.695 | 2.263 | 1.615 | 0.774 | — | 2.65 | 2.036 | 1.695 |
| Ashless Dispersant (N %) | 0.016 | 0.106 | 0.016 | 0.016 | 0.016 | 0.016 | 0.016 | — | — |
| Zn-DTP (P %) | 0.019 | 0.019 | 0.019 | 0.019 | 0.019 | 0.019 | 0.019 | — | — |
| Ca Ratio (Phe/Sul) | 23:77 | 36:64 | 20:80 | 39:61 | 70:30 | 100:0 | 23:77 | 36:64 | |
| Wear Results, μm | 11.4 | 16.3 | Scuff | Scuff | 6.5 | 4.5 | Scuff | Scuff | Scuff |

The results in Table 1 indicate the diesel marine engine-cylinder lubricating oil compositions of the present invention (Examples 1 and 2) containing an ashless dispersant and a zinc dihydrocarbyldithiophosphate, together with a certain combination of an overbased calcium sulfonate detergent and an overbased calcium phenate detergent, effectively prevents piston rings and cylinder liners from wearing and scuffing, if the ratio of phenate to sulfonate is adjusted to a specific range, i.e., in the range of 22:78 to 37:63.

Accordingly, this demonstrates that the lubricating oil compositions of the present invention employing a relatively large amount of a low cost detergent, i.e., calcium sulfonate, and a relatively small amount of a high cost detergent, i.e., calcium phenate, in a certain ratio can provide high thermal stability, wear-preventing and scuff-preventing performance in two-stroke cross-head diesel marine engines.

What is claimed is:

1. A lubricating oil composition comprising a base oil of lubricating viscosity having a kinematic viscosity of 22 to 300 $mm^2/s$ at 40° C. and dissolved or dispersed therein the following additives in the following amounts based on a total amount of the lubricating oil composition: (1) an overbased sulfurized alkylphenol calcium salt detergent in an amount of 0.5 to 1.0 wt. % in terms of calcium content, (2) an overbased calcium alkylbenzenesulfonate detergent in an amount of 1.5 to 2.1 wt. % in terms of calcium content, (3) a nitrogen-containing ashless dispersant in an amount of 0.005 to 0.1 wt. % in terms of nitrogen content, and (4) a zinc dihydrocarbyldithiophosphate in an amount of 0.007 to 0.1 wt. % in terms of phosphorus content, wherein the weight ratio of the overbased sulfurized alkylphenol calcium salt detergent to the overbased calcium alkylbenzenesulfonate detergent is in the range of 22:78 to 37:63 in terms of calcium content and wherein the lubricating oil composition has a total base number of 60 to 100 mg·KOH/g.

2. The lubricating oil composition according to claim 1, wherein the weight ratio of the overbased sulfurized alkylphenol calcium salt detergent to the overbased calcium alkylbenzenesulfonate detergent is in the range of 23:77 to 36:64 in terms of calcium content.

3. The lubricating oil composition according to claim 1, wherein the overbased sulfurized alkylphenol calcium salt detergent has a total base number of 200 mg·KOH/g or more.

4. The lubricating oil composition according to claim 1, wherein the overbased calcium alkylbenzenesulfonate detergent has a total base number of 250 mg·KOH/g or more.

5. The lubricating oil composition according to claim 1, wherein the nitrogen-containing ashless dispersant is a succinic imide having a polybutenyl group having a molecular weight of 800 to 8,000.

6. A method of improving the high temperature wear performance of two-stroke engines, said method comprising operating the two-stroke engine with a lubricating oil composition comprising a base oil of lubricating viscosity having a kinematic viscosity of 22 to 300 $mm^2/s$ at 40° C. and dissolved or dispersed therein the following additives in the following amounts based on a total amount of the lubricating oil composition: (1) an overbased sulfurized alkylphenol calcium salt detergent in an amount of 0.5 to 1.0 wt. % in terms of calcium content, (2) an overbased calcium alkylbenzenesulfonate detergent in an amount of 1.5 to 2.1 wt. % in terms of calcium content, (3) a nitrogen-containing ashless dispersant in an amount of 0.005 to 0.1 wt. % in terms of nitrogen content, and (4) a zinc dihydrocarbyldithiophosphate in an amount of 0.007 to 0.1 wt. % in terms of phosphorus content, wherein the weight ratio of the overbased sulfurized alkylphenol calcium salt detergent to the overbased calcium alkylbenzenesulfonate detergent is in the range of 22:78 to 37:63 in terms of calcium content and wherein the lubricating oil composition has a total base number of 60 to 100 mg KOH/g.

7. The method according to claim 6, wherein the two-stroke engine is a two-stroke cross-head diesel marine engine.

8. The method according to claim 6, wherein the weight ratio of the overbased sulfurized alkylphenol calcium salt detergent to the overbased calcium alkylbenzenesulfonate detergent is in the range of 23:77 to 36:64 in terms of calcium content.

9. The method according to claim 6, wherein the overbased sulfurized alkylphenol calcium salt detergent has a total base number of 200 mg·KOH/g or more.

10. The method according to claim 6, wherein the overbased calcium alkylbenzenesulfonate detergent has a total base number of 250 mg·KOH/g or more.

11. The method according to claim 6, wherein the nitrogen-containing ashless dispersant is a succinic imide having a polybutenyl group having a molecular weight of 800 to 8,000.

* * * * *